United States Patent [19]

Webster

[11] Patent Number: 4,716,693

[45] Date of Patent: Jan. 5, 1988

[54] STRUCTURE HAVING A MOVABLE PANEL

[75] Inventor: James A. Webster, London, Great Britain

[73] Assignee: Click Systems Limited, Milton Keynes, Great Britain

[21] Appl. No.: 855,097

[22] Filed: Apr. 22, 1986

[30] Foreign Application Priority Data

Apr. 22, 1985 [GB] United Kingdom ..... 8510235
Dec. 3, 1985 [GB] United Kingdom ..... 8529728

[51] Int. Cl.[4] ..... E04B 1/346
[52] U.S. Cl. ..... 52/64; 49/410
[58] Field of Search ..... 52/64, 506, 508, 511, 52/512; 49/410; 296/155

[56] References Cited

U.S. PATENT DOCUMENTS

| | | | |
|---|---|---|---|
| 1,988,260 | 1/1935 | Berghoff | 52/64 X |
| 2,736,603 | 2/1956 | Payne | 296/155 |
| 2,992,709 | 1/1961 | McIntosh | 52/64 X |
| 3,360,136 | 12/1967 | Ain | 49/410 X |
| 4,359,249 | 11/1982 | Fischer | 312/198 |
| 4,360,991 | 11/1982 | West | 52/64 X |
| 4,560,197 | 12/1985 | Minami | 296/155 |

FOREIGN PATENT DOCUMENTS

| | | | |
|---|---|---|---|
| 0075364 | 3/1983 | European Pat. Off. . | |
| 1268499 | 5/1968 | Fed. Rep. of Germany | 296/155 |
| 2133756 | 1/1973 | Fed. Rep. of Germany . | |
| 2241186 | 3/1974 | Fed. Rep. of Germany . | |
| 3142431 | 6/1983 | Fed. Rep. of Germany . | |
| 202802 | 5/1939 | Switzerland . | |
| 425097 | 3/1935 | United Kingdom . | |
| 433421 | 8/1935 | United Kingdom . | |
| 841385 | 7/1960 | United Kingdom . | |
| 1093768 | 12/1967 | United Kingdom . | |
| 1180231 | 2/1970 | United Kingdom . | |
| 1197941 | 7/1970 | United Kingdom . | |
| 1222959 | 2/1971 | United Kingdom . | |
| 1236850 | 6/1971 | United Kingdom . | |
| 1379627 | 1/1975 | United Kingdom . | |
| 2083118 | 3/1982 | United Kingdom . | |

*Primary Examiner*—William F. Pate, III
*Assistant Examiner*—Creighton Smith
*Attorney, Agent, or Firm*—Gottlieb, Rackman & Reisman

[57] ABSTRACT

A structure having a movable panel (5) has a support frame (8) having side portions (**8*b*) slidably mounted on supports to allow sliding movement of the frame (8) between a retracted and an extended position. The movable panel (5) is mounted on the frame (8) via interengaging track means preferably comprising a track of part-circular cross-section (1) and arcuate means (2). The arcuate means (2) allow a first tilting of the movable panel (5) from a flush-fitting plane to an inclined plane on sliding movement of the frame (8) from the retracted to the extended position, and also allow a subsequent second tilting of the movable panel (5) from the inclined plane to a non-flush plane substantially parallel to the flush-fitting plane. The interengaging means (1,2) allow lateral sliding of the movable panel (5) in the non-flush plane. Thus one end of the movable panel (5**) may be transferred between planes before the opposite end, enabling one person to handle large panels with ease. The need for large internal frames is obviated.

23 Claims, 18 Drawing Figures

STRUCTURE HAVING A MOVABLE PANEL

BACKGROUND OF THE INVENTION

The present invention relates to a structure having a movable panel.

In structures of this type it is known to use slidable or rollable devices to transfer a movable panel out of a flush-fitting plane into a parallel non-flush plane and to move the panel in a lateral manner such that an opening in the structure is presented. The known means for transferring the panel between planes may be provided by sets of slidable extension devices mounted perpendicular to the panel and positioned at the top and bottom thereof, and at additional intermediate positions for large panels. There is no quarantee of simultaneous movement of the extension devices since even movement of the panel is difficult and may be impossible with large panels. This may result in excessive stresses in the panel and any means allowing lateral movement thereof such that operation becomes difficult.

It is obvious that when the panel is required to be angled to the vertical when closed, e.g. for a glazed structure, the bearing surfaces or slides of the extension devices must be maintained horizontal in order to avoid the effect of gravity increasing the force required to transfer the panel between the flush-fitting and the non-flush planes. Difficulties are known to arise concerning the arrangement of the wheels or rollers of the devices used for lateral movement. particularly with regard to the angle of contact between the track and the rollers engageable therewith.

It is also a feature of known panelled structures that at least one internal frame is used to which the sets of slidable extension devices may be attached. Side panels may also be attached thereto.

SUMMARY OF THE INVENTION

An object of the invention is to obviate the need for even movement of the panel between planes and to reduce considerably the difficulties concerned with lateral movement of angled panels.

This is achieved according to the present invention wherein a structure is provided comprising a movable panel, means allowing movement of the panel between a flush-fitting and a non-flush plane, means allowing lateral movement of the panel in the non-flush plane and means allowing tilting of the panel between the flush-fitting and the non-flush plane such that movement of the panel between the planes is facilitated.

Preferably, a frame having a front portion and two side portions is situated adjacent to the movable panel. Preferably, the means allowing the tilting and lateral movement are mounted on the front portion of the frame and form a connection between the frame and the panel. The tilting and lateral movement means may comprise a part-circular track engageable by part-spherical rollers or wheels or by carriers presenting ball race abutments or pairs or sets of wheels to the track. Equally, the track may be slidably engageable by a rod of substantially part-circular cross section. The tilting movement is facilitated by the rotation of the rollers, wheels, carriers or rod in the track in the plane of part-circular cross section and about the centre of curvature thereof, while the lateral movement is facilitated by the rolling of the rollers, wheels or carriers or by the sliding of the rod in the track.

The extension devices facilitating movement of the panel between the flush-fitting and non-flush planes are mounted on the side portions of the frame. These devices may be any slidable device, but are preferably of the same type used to facilitate tilting and lateral movement.

The frame is connected to the structure by the tilting and lateral movement means and extension devices which may be mounted directly on the panels of the structure. A large internal frame is not required and the panels may be easily and directly connected so as to support each other.

In a preferred arrangement relating to a rectangular panel, at least two frames as described above may be present in the structure according to the invention. These may be located at the top and bottom of the panel and at any intermediate position therebetween. The tilting means allow one end of the panel to be extended between the flush-fitting and non-flush planes before the opposite end is moved. Thus the movable panel may be extended into the non-flush plane and moved laterally into an open position by one person.

The tilting means also allow the movable panel to remain angled to the vertical at all times without requiring any adjustment to the components of the frame and means attached thereto, by virtue of the relative rotatability of the rollers, wheels, carriers or rod and the track.

In a further preferred arrangement, e.g. when the panel is inclined and/or triangular or narrow at one end, it may not be possible or desirable to employ two frames.

A single frame may then be positioned at one end. The opposite end may be held in place in the fully closed position, preferably by a trapping channel or the like, resilient means being attached between the panel and tilting means. Tilting of the panel by extension of one end into a non-flush plane preferably releases the opposite panel end allowing the resilient means to bring the opposite panel end into the desired non-flush plane.

The present invention may be applied to any structure requiring an openable flush-fitting panel with a concealed mechanism. In particular it may be applied to a showcase or display unit where the panels are made of glass or similar transparent material and each panel forms one complete side of the unit. Alternatively, the movable panel may form part of a large flush fitting planar structure, for example a floor, wall or ceiling. The invention may equally be applied to partitions, window displays, museum display panels and structures, access panels and doors in machinery, vehicles, plant and containers, building, domestic and commercial furniture systems.

BRIEF DESCRIPTION OF THE DRAWINGS

Embodiments of the invention will now be described with reference to FIGS. 1 to 15 of the accompanying drawings wherein.

DETAILED DESCRIPTION OF THE DRAWINGS

Figure 1:
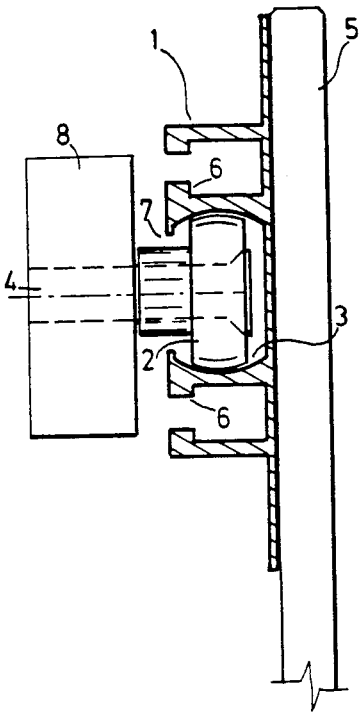
FIG. 1 is a cross section through the track and roller assembly of the tilting and lateral movement means of a first embodiment relating to a display unit with the panel in a vertical position.

In the embodiment shown in FIG. 1, a track 1 is mounted on a movable panel 5 and comprises an extruded or rolled main profile having a main channel of part-circular cross section 3 and may have additional channels, abutments or linear form screw threads 6 for additional or corner fixing. Fitting closely into the main channel 3 are wheels or rollers 2 having a part-spherical shape, being carried on axles 4 and mounted on the front section of a frame 8. It will be appreciated that the track and roller configuration may be reversed, the track 1 being attached to the frame 8 and the rollers 2 being mounted on the panel 5.

Figure 2:
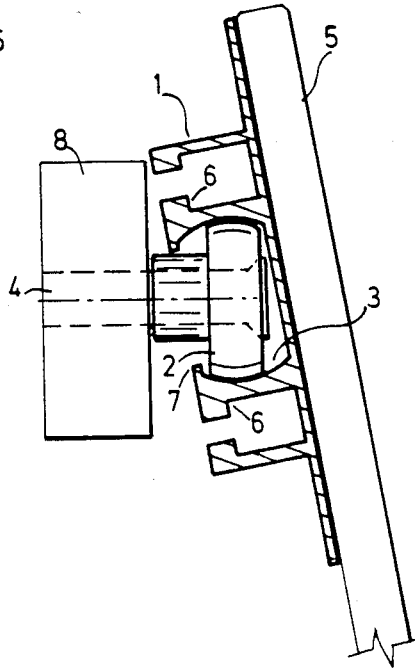
FIG. 2 is the same cross section as in FIG. 1 but with the panel in a tilted position.

The close fitting form of the rollers 2 and channel 3 allow the tilting movement to take place as shown in FIG. 2, occurring when the panel 5 is extended at the top or bottom only. Excessive rotation is prevented by contact of the roller 2 with a protruding lip 7.

Alternative arrangements for providing tilting and lateral movement means are shown in FIGS. 3 to 5.

Figure 3A:
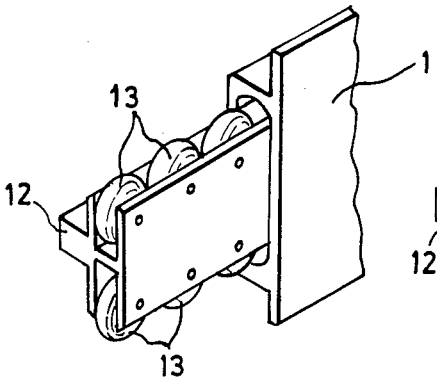
FIGS. 3*a* and 3*b* show perspective and sectional views of a first alternative embodiment of the tilting and lateral movement means.
Figure 3B:
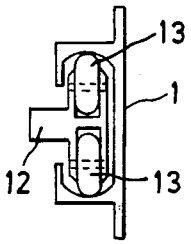

FIGS. 3*a* and 3*b* show an arrangement comprising a carrier 12 on which are mounted pairs of part-spherical rollers 13 such that the rollers 13 engage with the track 1.

Figure 4A:
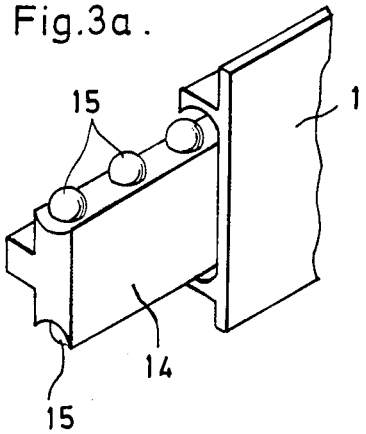
FIGS. 4*a* and 4*b* show perspective and sectional views of a second alternative embodiment of the tilting and lateral movement means.
Figure 4B:
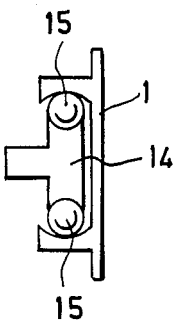

FIGS. 4*a* and 4*b* show a similar arrangement comprising a carrier 14 having ballrace abutments 15 engaging with the track 1.

Figure 5A:
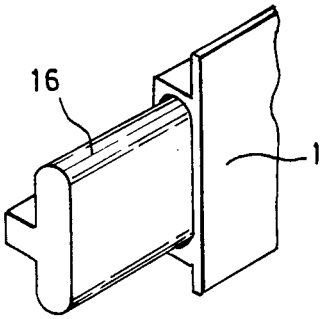
FIGS. 5*a* and 5*b* show perspective and sectional views of a third alternative embodiment of the tilting and lateral movement means.
Figure 5B:
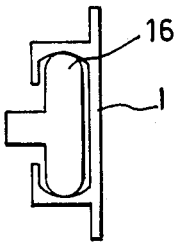

FIGS. 5*a* and 5*b* show an arrangement having a solid bar 16 of part-circular cross section slidably and rotatably mounted in the track 1.

Figure 6:
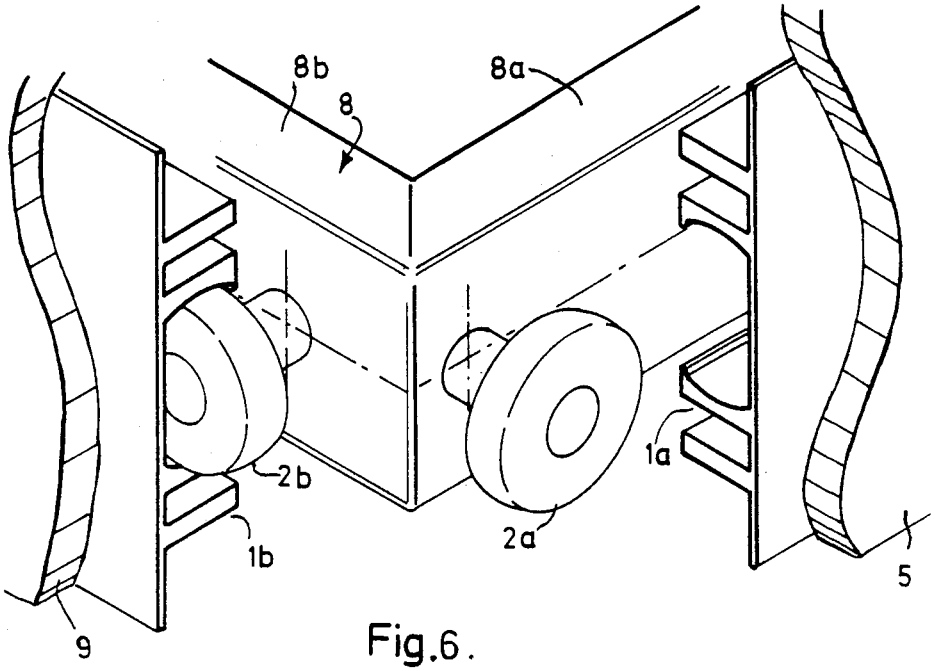
FIG. 6 shows a perspective view of one corner of the frame shown in FIG. 1 and the corresponding track and rollers.

The frame 8 is shaped such that two side portions extend horizontally from the front portion in a direction perpendicular to the front portion. In the case of a rectangular display unit, the side portions may be parallel to fixed side panels and may be attached thereto. As may be seen from FIG. 6, the frame 8 is positioned such that the front portion 8*a* is parallel to the movable panel 5, and the side portion 8*b* is parallel to side panel 9. Tracks 1*a*, 1*b* are attached to the panels 5, 9 respectively; track 1a having the particular cross section described above. Track 1b is preferably of the same cross section. A plurality of rollers 2*a* engage track 1*a* and a further plurality of rollers 2*b* engage track 1*b*. Two frames 8 are provided, one positioned at the top of the movable panel and the second at the bottom. Means (not shown) may be provided such that the extension and lateral movement is limited so as to prevent total disengagement of the tracks 1*a*, 1*b* from the rollers 2*a*, 2*b*.

Figures 7, 8, 9:
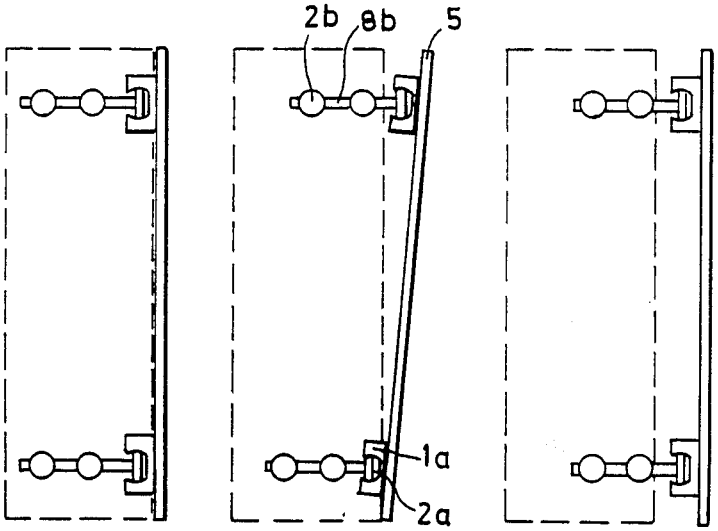
FIG. 7 is a diagrammatic side view of the movable panel shown in FIG. 1 in the flush-fitting closed position.
FIG. 8 is a diagrammatic side view of the tilted movable panel shown in FIG. 1 with one end extended into the non-flush plane.
FIG. 9 is a diagrammatic side view of the movable panel shown in FIG. 1 fully extended in the non-flush plane.

In the fully closed position shown in FIG. 7, all rollers 2*a*, 2*b* make contact with the tracks 1*a*, 1*b* and the movable panel 5 is fitted flush to the side panel 9. In order to extend the movable panel 5 into the non-flush plane, one end may be extended before the other as shown in FIG. 8. The rollers 2*b* and track 1*b* of the upper frame 8 move slidably to extend the top end of panel 5, while the rollers 2*a* of both frames 8 rotate in the part-circular tracks 1*a* without lateral motion, such that the panel 5 is tilted. The bottom end may then be extended in a similar way, the rollers 2*b* and track 1*b* of the lower frame moving slidably to allow extension to occur. The rollers 2*a* rotate in the tracks 1*a* back to their original positions, again without lateral motion. The extended position is shown in FIG. 9. The panel 5 may then be moved laterally by sliding of the rollers 2*a* in track 1*a* such that an opening is provided in the panelled structure.

The panel may be closed by reversal of the above procedure.

Figure 10:
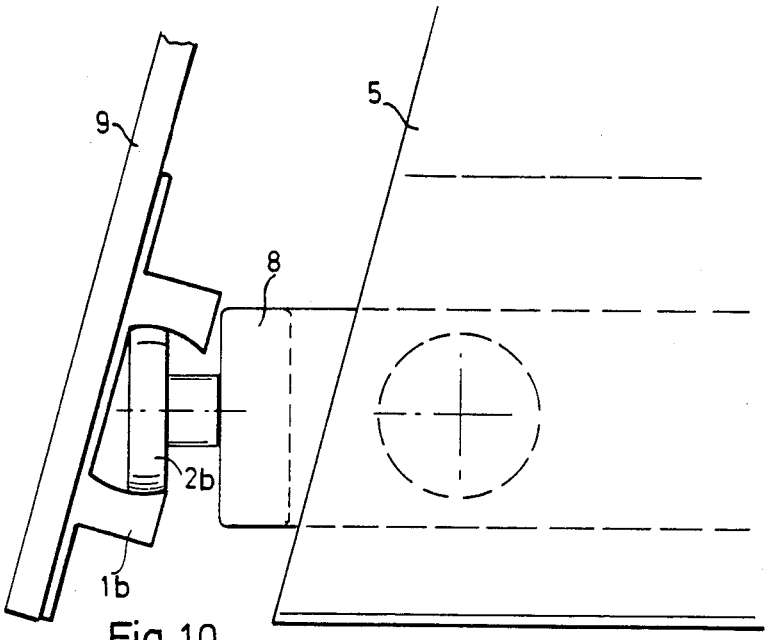
FIG. 10 is a cross section through the track and roller assembly of a structure of a second embodiment relating to a display unit having a movable panel and a side panel inclined to the vertical.

In FIG. 10 an embodiment having inclined panels is described. The frame 8 is horizontal and tracks are attached to both the movable and fixed panels 5, 9. The part-circular track 1*b* allows the rollers 2*b* to operate in a permanently tilted position. This arrangement may impose a particular order in which the ends of the movable panel 5 may be extended due to limitation of rotation of the rollers 2*b* relative to the track 1*b*. The panel 5 should preferably be extended such that the first end to be extended reduces the angle of incline to the vertical. Once the panel 5 is in the non-flush plane, lateral movement may take place as described above.

Figure 11:
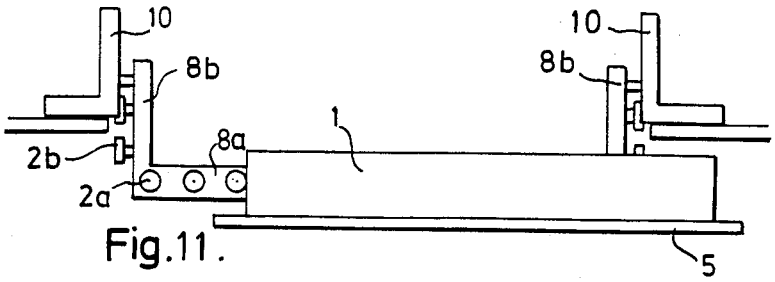
FIG. 11 shows a cross section through a structure according to the invention as applied to a rectangular ceiling panel.
Figure 12:
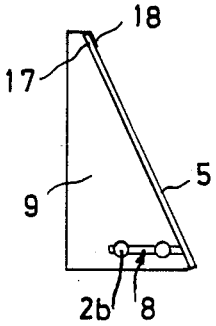
FIG. 12 is a diagrammatic side view of a third embodiment having a movable panel inclined to the vertical and mounted on a single frame, the panel being shown in the fully closed position.

In the embodiment shown in FIG. 11, the movable panel 5 lies flush with adjacent panels in the fully closed position. In this case, the side portions 8*b* of the frame extend vertically from the front portion 8*a* and carry rollers 2*b* engageable in tracks 1*b* so as to facilitate vertical movement of the panel 5 between the flush-fitting and non-flush planes. Means (not shown) may be provided to allow the panel to be held in the fully closed position. Two frames 8 are provided on opposite sides of the movable panel 5.

Side frames having vertical portions 10 carrying the track used to facilitate vertical extension of the panel 5 are attached to panels adjacent to the panel 5. The panel 5 is extended to a non-flush plane below the flush-fitting plane and is then moved laterally so as to overlap an adjacent panel and provide an opening in the structure.

Figure 13:
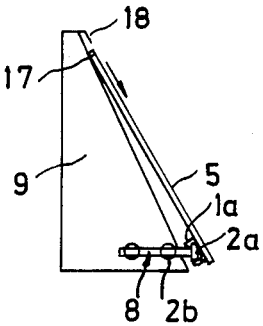
FIG. 13 shows the structure of FIG. 12 with the single frame extended into the non-flush plane.
Figure 14:
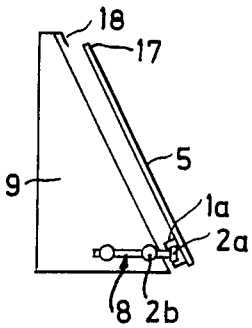
FIG. 14 shows the structure of FIGS. 12 and 13 with the movable panel fully extended into the non-flush plane and, FIG. 15 is a perspective view of the structure of FIGS. 12 to 14 with the panel in the open position.
Figure 15:
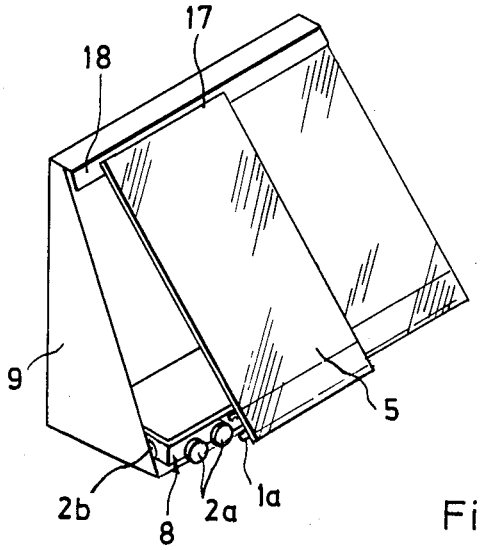

FIGS. 12 to 15 relate to an embodiment of the invention having an inclined movable panel 5 and having one frame 8 located at the bottom of panel 5. The upper end 17 of panel 5 is trapped under a trapping channel 18 when in the fully closed position shown in FIG. 12. In order to extend the panel 5 into a non-flush plane, rollers 2b are moved slidably in tracks (not shown) such that the lower end of panel 5 is extended as shown in FIG. 13. The extension causes the upper end 17 to move in the direction of the arrow to a position where it is no longer trapped by the trapping channel 18. Resilient means (not shown) are attached such that when the upper end 17 is clear of the trapping channel 18, the panel 5 rotates about rollers 2a until the required position in the non-flush plane is achieved as shown in FIG. 14. Lateral motion is now possible and the structure with the panel 5 in the open position is shown in FIG. 15.

Similar embodiments providing polygonal movable panels in horizontal, vertical or inclined planar surfaces are obvious and may be provided by carrying out alterations to the above described embodiments.

What is claimed is:

1. A structure comprising support means, a support frame having a front portion and two side portions, said two side portions being slidably mounted on said support means to allow sliding movement of said frame between a retracted and and extended position relative to said support means, a movable panel mounted on said front portion of said frame, and interengaging track means mounting said movable panel on said front portion of said frame and comprising arcuate members operable for allowing a first tilting of said movable panel between a flush-fitting plane and an inclined plane on sliding movement of said frame from said retracted position to said extended position thereof and for allowing a second tilting of said movable panel between said inclined plane and a non-flush plane substantially parallel to said flush-fitting plane, said arcuate members of said interengaging track means being further operable to permit said movable panel to move laterally along said front portion of said frame when said movable panel is in said non-flush plane.

2. A structure according to claim 1, wherein said arcuate members are partially disengageable to allow lateral movement of said panel beyond said front portion of said frame.

3. A structure according to claim 2, wherein said support means mounting said two side portions of said frame comprise further interengaging track means substantially the same as said interengaging track means mounting said movable panel on said front portion of said frame.

4. A structure according to claim 3, wherein said side portions of said frame lie in a substantially horizontal plane.

5. A structure according to claim 4, wherein said structure further comprises fixed panels mounting said support means.

6. A structure according to claim 1, wherein said movable panel has first and second opposed edges, said support frame being arranged adjacent said first edge, said structure further comprising a second said support frame and second said interengaging track means arranged adjacent said second edge, said second support frame being slidable between retracted and extended positions for allowing said second tilting of said movable panel.

7. A structure according to claim 6, wherein said flush-fitting plane is substantially vertical and said side portions of each said frame lie in a substantially horizontal plane.

8. A structure according to claim 7, wherein said structure is a showcase or display unit.

9. A structure according to claim 1, wherein said movable panel has first and second opposed edges, said support frame being arranged adjacent said first edge, said structure further comprising holding means for holding said second edge of said movable panel in said flush-fitting plane, said second edge being releasable from said holding means on said first tilting of said movable panel.

10. A structure according to claim 1, wherein said movable panel has a first edge and a corner opposed thereto, said support frame being arranged adjacent said first edge, said structure further comprising holding means for holding said corner of said movable panel in said flush-fitting plane, said corner being releasable from said holding means on said first tilting of said movable panel.

11. A structure according to claim 9, wherein said structure further comprises resilient means for moving said movable panel into said non-flush plane upon release of said second edge from said holding means.

12. A structure according to claim 11, wherein said flush-fitting plane is inclined to the vertical.

13. A structure according to claim 12, wherein said structure is a showcase or display unit.

14. A structure according to claim 1, wherein said structure comprises a plurality of panels lying in a single non-horizontal plane and said side portions of said frame lie in a substantially horizontal plane.

15. A structure according to claim 14, wherein said structure is a wall, partition or panel.

16. A structure according to claim 6, wherein said structure comprises a plurality of panels lying in a substantially horizontal plane, said side portions of each said frame lying in a substantially vertical plane.

17. A structure according to claim 16, wherein said structure is a floor or ceiling.

18. A structure according to claim 2, wherein said arcute members comprise a track of part-circular cross-section and corresponding arcuate means received in end slidably and angularly displaceable relative to said track.

19. A structure according to claim 18, wherein said corresponding arcuate means comprise a plurality of part-spherical rollers.

20. A structure according to claim 18, wherein said corresponding arcuate means comprise a carrier and a plurality of part-spherical rollers mounted on said carrier.

21. A structure according to claim 18, wherein said corresponding arcuate means comprise a carrier having two ballrace abutments and a plurality of balls rotatably mounted on said ballrace abutments.

22. A structure according to claim 18, wherein said corresponding arcuate means comprise a bar of substantially part-circular cross-section having substantially the same diameter as said track.

23. A structure according to claim 2, wherein said structure further comprises means for preventing total disengagement of said arcuate members.

* * * * *